US009844944B2

(12) United States Patent
Cessel et al.

(10) Patent No.: US 9,844,944 B2
(45) Date of Patent: Dec. 19, 2017

(54) PRINTING SYSTEM SERVICING

(71) Applicant: HEWLETT-PACKARD DEVELOPMENT COMPANY, L.P., Houston, TX (US)

(72) Inventors: Gianni Cessel, Rubi (ES); Jose Luis Valero Navazo, Sant Cugat del Valles (ES); Jeff Allen Wagner, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/182,938

(22) Filed: Jun. 15, 2016

(65) Prior Publication Data

US 2016/0297204 A1 Oct. 13, 2016

Related U.S. Application Data

(63) Continuation of application No. 14/427,566, filed as application No. PCT/US2012/056264 on Sep. 20, 2012, now Pat. No. 9,427,970.

(51) Int. Cl.

| | |
|---|---|
| ***B41J 2/165*** | (2006.01) |
| ***B41J 2/15*** | (2006.01) |
| ***B41J 2/155*** | (2006.01) |
| ***B41J 25/00*** | (2006.01) |

(52) U.S. Cl.

CPC ..... *B41J 2/16585* (2013.01); *B41J 2/15* (2013.01); *B41J 2/155* (2013.01); *B41J 2/16505* (2013.01); *B41J 2/16535* (2013.01); *B41J 2/16544* (2013.01); *B41J 25/001* (2013.01); *B41J 2002/1655* (2013.01); *B41J 2002/1657* (2013.01); *B41J 2002/16573* (2013.01); *B41J 2002/16591* (2013.01)

(58) Field of Classification Search

CPC ..... B41J 2/16535; B41J 2002/1657; B41J 2002/16582; B41J 2/16585

See application file for complete search history.

(56) References Cited

U.S. PATENT DOCUMENTS

| | | | |
|---|---|---|---|
| 5,838,343 | A | 11/1998 | Chapin et al. |
| 6,783,209 | B2 | 8/2004 | Gompertz |
| 6,866,362 | B2 | 3/2005 | Kimura et al. |

(Continued)

FOREIGN PATENT DOCUMENTS

| | | | |
|---|---|---|---|
| CN | 1446692 | A | 10/2003 |
| CN | 1533897 | A | 10/2004 |

(Continued)

OTHER PUBLICATIONS

MacDermid, "DisplayMaker 72S/SR," High-Performance, Low-Cost Solvent Inkjet Printers, Copyright 2004 MacDermid ColorSpan, Inc., 4 pgs.

*Primary Examiner* — Kristal Feggins
*Assistant Examiner* — Kendrick Liu
(74) *Attorney, Agent, or Firm* — HP Inc. Patent Department

(57) ABSTRACT

A printing system includes a print bar, a plurality of printheads installed on the print bar and an auxiliary printhead moveable parallel to the print bar. A number of first nozzles of the auxiliary printhead substitute for a number of second nozzles of the printheads during a nozzle servicing operation performed on the second nozzles.

20 Claims, 4 Drawing Sheets

(56) References Cited

U.S. PATENT DOCUMENTS

| | | | | |
|---|---|---|---|---|
| 6,988,842 | B2 | 1/2006 | Miller et al. | |
| 7,278,699 | B2 | 10/2007 | Drake et al. | |
| 7,866,788 | B2 | 1/2011 | Jorba et al. | |
| 2003/0222939 | A1 | 12/2003 | Gompertz | |
| 2004/0189741 | A1 | 9/2004 | Kimura et al. | |
| 2004/0218003 | A1 | 11/2004 | Monclus et al. | |
| 2004/0263556 | A1 | 12/2004 | Urrutia et al. | |
| 2005/0069365 | A1 | 3/2005 | Miller et al. | |
| 2005/0156975 | A1* | 7/2005 | Inoue | B41J 3/543 347/13 |
| 2006/0152546 | A1 | 7/2006 | Udagawa | |
| 2006/0227157 | A1 | 10/2006 | Drake et al. | |
| 2007/0070120 | A1* | 3/2007 | Heo | B41J 3/543 347/40 |
| 2008/0238990 | A1* | 10/2008 | Inoue | B41J 2/16552 347/33 |
| 2009/0091596 | A1 | 4/2009 | Askeland et al. | |

FOREIGN PATENT DOCUMENTS

| | | | |
|---|---|---|---|
| CN | 102529383 | A | 7/2012 |
| EP | 1769920 | A1 | 4/2007 |
| JP | 2005-231352 | | 9/2005 |
| JP | 2005-305845 | A | 11/2005 |
| JP | 2008-087209 | | 4/2008 |
| JP | 2008-149709 | | 7/2008 |
| JP | 2010-184447 | | 8/2010 |
| JP | 2011-068092 | | 4/2011 |

* cited by examiner

PRINTING SYSTEM SERVICING

RELATED DOCUMENTS

The present application is a continuation, and claims the benefit under 35 U.S.C. §120, of U.S. application Publication Ser. No. 14/427,566, filed Mar. 11, 2015 which is the national stage entry of International Patent Application No. PCT/US12/056264 filed Sep. 20, 2012. These applications are herein incorporated by reference in their entireties.

BACKGROUND

Inkjet printheads may suffer from printhead nozzles becoming blocked or partially obstructed due to ink residue in proximity to the nozzles hardening. Blocked or obstructed printhead nozzles may lead to print quality issues, especially if ink drops are not ejected by a nozzle as planned during a printing operation.

In printing systems that use moveable printheads, such as printing systems that have printheads that are moveable over a print zone, a printhead may be moved out of a print zone and into a printhead service station. In the printhead service station printhead nozzles may be serviced, for example by being purged into a spittoon, or by being wiped with a mechanical wiping mechanism, before being returned to the print zone.

BRIEF DESCRIPTION OF THE DRAWINGS

Examples, or embodiments, of the invention will now be described, by way of non-limiting example only, with reference to the accompanying drawings, in which.

DETAILED DESCRIPTION

Figure 1:
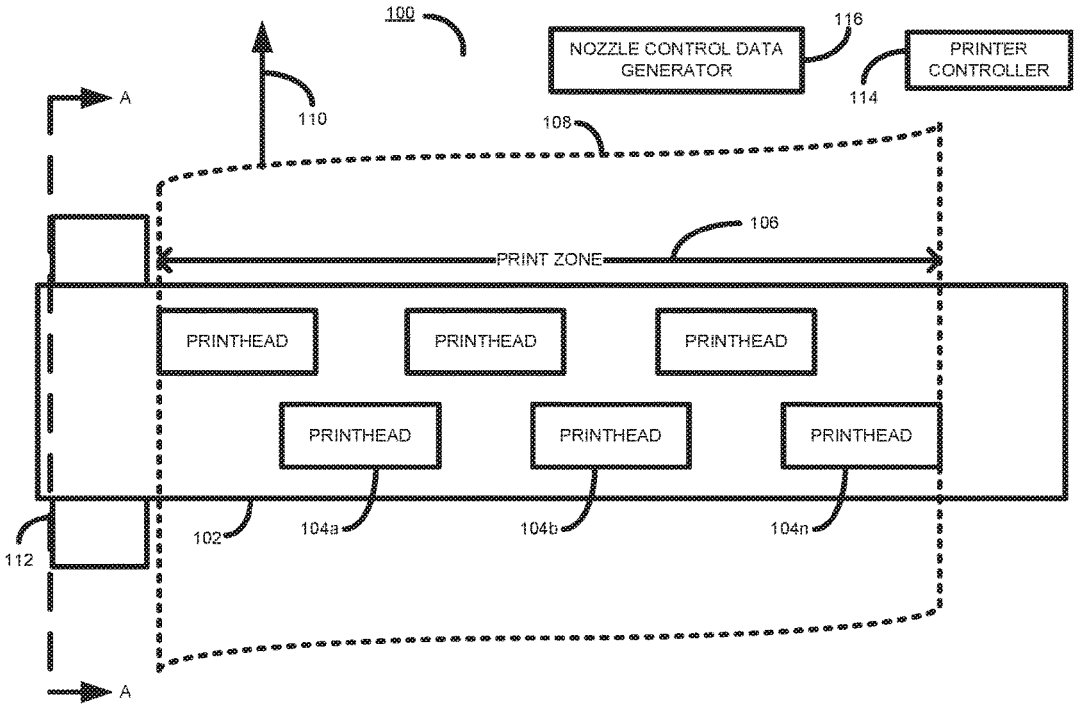
FIG. 1 is a block diagram of a portion of a printing system according to one example.

Referring now to FIG. 1 there is shown a simplified block diagram of a printing system 100 according to one example.

The printing system 100 is a page-wide array printing system that has a print bar 102 on which are installable a plurality of inkjet printheads 104. The printheads may be any kind of inkjet printhead, such as thermal inkjet printheads or piezo inkjet printheads. The printheads 104 are arranged in a longitudinal array configuration such that the printheads cover substantially the whole width of a print zone 106 in which printing may be performed. The printing system 100 may thus print along the whole width of a substrate 108 in the print zone 106 by advancing the substrate in a media advance direction 110 perpendicular to the print bar under the print bar 102. In the example shown the printheads are arranged in a staggered configuration, although in other examples a non-staggered linear configuration could be used.

Operation of the printing system 100 is controlled by a printer controller 114.

The printing system 100 comprises a nozzle control data generator 116 that generates printhead nozzle firing data based on data representing an image to be printed. In one example the nozzle control data generator 116 is integrated into the printer controller 114, although in another example it is separate from the printer controller 114. The generated nozzle control data is fed to the printheads 104 such that appropriate nozzles of the printheads 104 eject ink drops at specific times to recreate an image to be printed on the substrate 108 as the substrate 108 is advanced under print bar 102.

The printing system 100 is arranged such that the print bar 102 is not moveable out of the print zone 106 during normal operation of the printing system 100. In some examples, the printing system 100 may be a wide-format printing system in which case the print bar 106 may be in excess of 1 m in length. Accordingly, it is not generally practical to have such a print bar moveable out of the print zone 106 to perform nozzle servicing operations.

Figure 2:
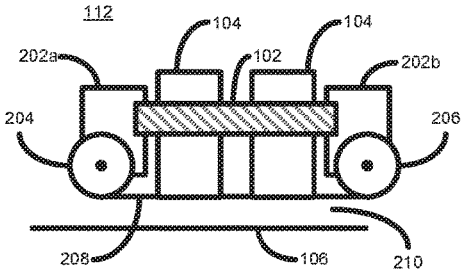
FIG. 2 is section view of a nozzle wiping module according to one example.

The printing system 100 additionally comprises a nozzle servicing module 112, an example of which is shown in greater detail in FIG. 2.

The nozzle servicing module 112 is moveable along the length of the print bar 102 to perform nozzle servicing operations on the nozzles of printheads 104 installed on the print bar 102.

FIG. 2 shows a section view of a nozzle servicing module 112 according to one example.

The nozzle servicing module 112 is supported on the print bar 102 by a pair of guide members 202. The guide members 202 allow the nozzle servicing module 202 to move along the length of the print bar 102. The print bar 102 may have shaped side members into which the guide members 202 fit or engage. The guide members 202 may include, for example, suitable bearings or bushes to reduce friction between the nozzle servicing module 112 and the print bar 102.

Although not shown in FIG. 2, the nozzle servicing module 112 includes a drive system to enable the nozzle servicing module 112 to be moved along the length of the print bar 102 under control of the printer controller 114. The drive system may include, for example, a motorized belt, a motor, or any other suitable drive mechanism.

On guide member 202*a* is mounted an unwind roller 204, and on guide member 202*b* is mounted a wind roller 206. On the roller 204 is wound a length of nozzle wiping material 208. In one example a textile material such as a microfiber cloth, may be used. The nozzle wiping material 208 feeds beneath the printheads 104 on the print bar 102 and is attached to the wind roller 206. In one example the wind roller 206 is powered by an electric motor and the unwind roller 204 has a built-in resistance to unwinding, such that when the wind roller 206 rotates in a winding direction, the nozzle wiping material is held taught. In one example the unwind roller 204 is also powered to enable the nozzle wiping material 208 to wound back onto the unwind roller to allow a reciprocating wiping motion to be performed.

In one example the unwind roller 204 and wind roller 206 are positioned such that when the nozzle wiping material is held taught it exerts a pressure on printhead nozzles enabling them to be effectively wiped. In the present example the unwind and wind rollers are arranged such that wiping occurs in a direction orthogonal to the longitudinal axis of the print bar 102 when the wind roller is activated. In other examples, unwind and wind rollers are arranged such that wiping occurs in a direction oblique to the longitudinal axis of the print bar 102.

Wiping may thus occur when the nozzle servicing module 112 is moved along the print bar, when the wind roller 206 winds nozzle wiping material 208 from the unwind roller 204, or a combination of the two.

The thickness of the nozzle wiping material 208 is chosen such that it fits within the printhead-to-substrate gap 210 which may be in the order of between about 1 to 10 mm. In one example the width of the nozzle wiping material is less than or equal to the width of a printhead.

The nozzle servicing module 112 is controllable, by the printer controller 114, to move along the length of the print bar 106 and also to cause a group of nozzles to be wiped by controlling the powered wind roller 206. In this way, all of the nozzles of all of the printheads 104 may be serviced by the nozzle servicing module 112 without requiring the print bar to be moved to a service station, and, importantly, without requiring the print bar to be raised. In one example the nozzle servicing module 112 includes an encoder, such as an optical encoder, and the print bar 106 includes an encoder strip that is readable by the encoder, such that the position of the nozzle servicing module 112 is precisely determinable and precisely controllable.

Such a nozzle servicing module thus presents numerous advantages. However, performing a nozzle servicing operation does lead to interruption of a printing operation since the nozzles being services are unable to be used in a printing operation.

Figure 3:
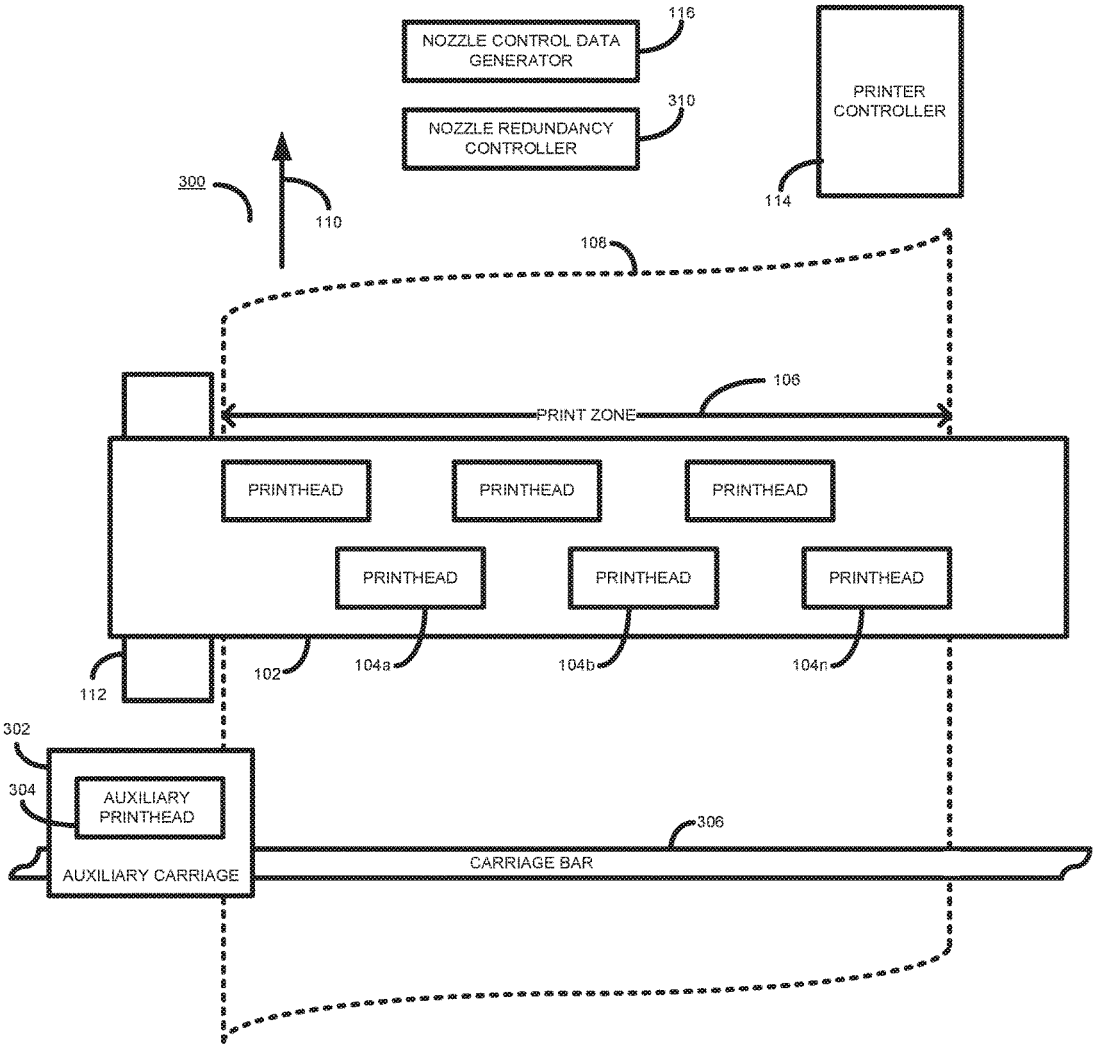
FIG. 3 is a block diagram of a portion of a printing system according to one example.

A further example, described below with reference to FIGS. 3, 4 and 5, aims to overcome the aforementioned shortcomings by providing a printing system 300 having an auxiliary carriage 302 on which is installable an auxiliary printhead 304, in addition to a nozzle servicing module 112. In one example the auxiliary printhead 304 has the same characteristics as the other printheads 104 on the print bar 102. In other examples, multiple printheads may be installable on the carriage 302.

The carriage 302 is moveable along a carriage bar 306 parallel to the print bar 108 under control of the printer controller 114. In one example the carriage bar 306 is positioned upstream from the print bar 102, although in another example the carriage bar 306 is positioned downstream from the print bar 102.

The auxiliary printhead 304 selectively provides nozzle redundancy for a group of nozzles being serviced by the nozzle servicing module 112, thereby enabling the nozzle servicing module 112 to perform a servicing operation on a group of printhead nozzles during a printing operation, such as printing a print job, without interruption of the printing operation.

Thus, as the nozzle servicing module 112 moves across the print bar 102 performing servicing operations on groups of printhead nozzles, printhead nozzles obscured by the nozzle servicing module 112 are replaced by nozzles on the auxiliary printhead 304. Nozzle firing data for the replaced nozzles is diverted to the auxiliary printhead 304, to enable the auxiliary printhead 304 to print those ink drops originally intended to be printed by those nozzles being serviced, as described further below. In one example, the nozzle firing data controls nozzle drive circuitry that causes a nozzle to eject ink drops.

In this manner, the printing system 300 is able to service printhead nozzles without interrupting a printing operation, such as a print job. In one example the speed at which media is advanced under the print bar 102 is the same during a printhead servicing operation as during a regular printing operation. In a further example the speed at which the media is advanced under the print bar 102 is reduced during a printhead servicing operation compared to the speed of a regular printing operation.

This system provides an important advantage, for example in commercial printers, as it helps increase the amount of time that a printing system is operational, since it becomes no longer necessary to stop printing operations to perform a printhead servicing operation.

To enable nozzles of the auxiliary printhead 304 to temporarily replace nozzles of one or multiple ones of the printheads 104 the printing system 300 additionally comprises a nozzle redundancy controller 310. In one example the nozzle redundancy controller 310 is integrated into the printer controller 114, although in another example the nozzle redundancy controller 310 is separate from the printer controllers 114.

The nozzle redundancy controller 310 diverts printhead nozzle firing data generated by the nozzle control data generator 116 intended for nozzle circuitry of a printhead 104 on the print bar 106 to nozzle circuitry on the auxiliary printhead 302. In this way nozzles of the auxiliary printhead 304 print a portion of the image to be printed instead of the portion of the image being printed by nozzles of printheads 104.

Since the auxiliary printhead 302 is not located in the same vertical plane as the printheads 104 on the print bar 106, appropriate modification to the timing of nozzle firing data is performed by the nozzle redundancy controller 310, as will be described in greater detail below. The amount of modification may be based on the horizontal distance between printheads 104 on the print bar 106 and the printhead 304 on the carriage 306.

A method of operating the printing system 100 will now be described in greater detail with reference to FIG. 4 and FIG. 5.

Figure 6:
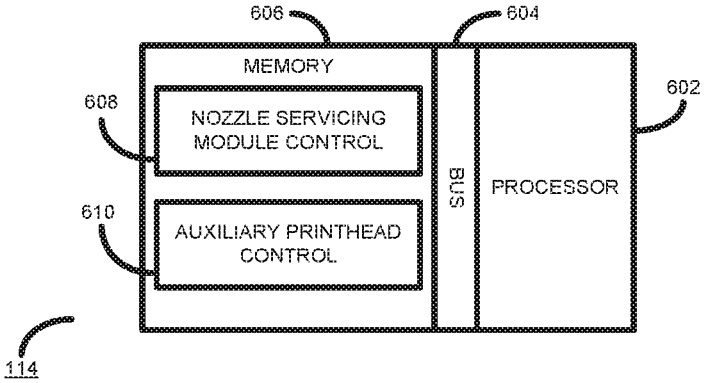
FIG. 6 is a block diagram of a controller according to one example.

The operation is controlled by the printer controller 114, a more detailed illustration of which is shown in FIG. 6.

The printer controller 114 comprises a processor 602, such as a microprocessor or microcontroller, and a memory 606 coupled to the processor 602 by a communications bus 604. The memory 606 stores processor executable nozzle servicing module control instructions 608 that, when executed by the processor 602 cause the controller 114 to control the nozzle servicing module 112 as described herein. The memory 610 also stores processor executable auxiliary printhead control instructions 608 that, when executed by the processor 602 cause the controller 114 to control the auxiliary printhead 304.

Figure 4A:
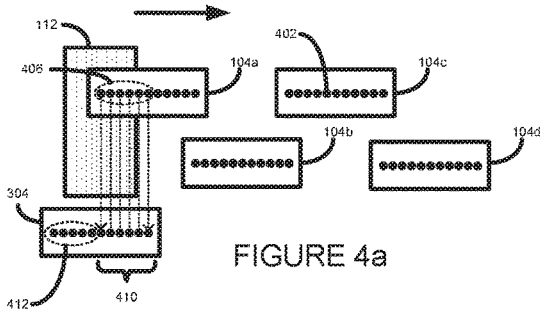
FIGS. 4*a* to 4*d* are block diagrams showing a portion of a printing system according to one example.
Figure 4C:
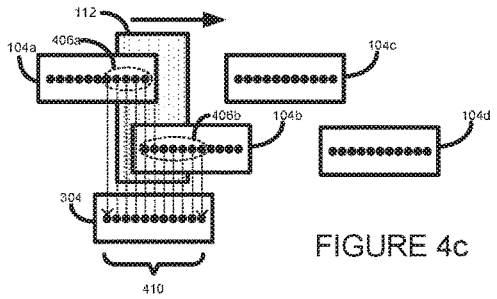

Turning now to FIG. 4*a* is shown a portion of the printing system 300 in greater detail. A number of printheads 104 on a print bar are shown however, for reasons of clarity the print bar 102 is not shown. Each printhead 104 has a number of nozzles 402 through which ink or other fluid may be ejected in response to appropriate nozzle firing data being received by nozzle circuitry in the printhead. In FIG. 4 only a small number of nozzles are shown on each printhead for clarity. However, it will be appreciated that a printhead 104 may comprise a many hundreds or thousands of nozzles.

When not used the nozzle wiping module 112 is parked in a parking area on the print bar 106 where it does not obstruct any nozzles. When a nozzle servicing operation is to be performed the nozzle wiping module 112 is moved, under control of the printer controller 114, out of a first parking zone at one end of the print bar and along the print bar 106. In one example the nozzle wiping module 112 is moved across the whole length of the print bar 102 to a second parking zone at the other end of the print bar.

In one example the auxiliary printhead is positioned such that nozzles on the auxiliary printhead extend laterally beyond the nozzle servicing module 112, as shown in FIG. 4*a*. In this way, as the nozzle servicing module 112 and the auxiliary printhead move across the print bar 102 the nozzles on auxiliary printhead 304 lead those nozzles on printheads 104 about to be obscured by the nozzle servicing module. This enables the end nozzles of the auxiliary printhead to replace corresponding nozzles on a printhead about to be serviced, before those nozzles are actually obscured by the nozzle servicing module 112.

At block 502 the controller 114 starts moving the nozzle wiping module 112 and the auxiliary printhead 302 from a parking zone along the print bar 106.

At block 504 the controller 114 determines whether any nozzles of any printheads, if any, are obscured by the nozzle wiping module 112.

If the controller 114 determines that one or multiple nozzles are obscured by the nozzle wiping module 112, the controller 114 transfers nozzle control data intended for nozzle circuitry of those obscured nozzles to nozzle circuitry of appropriate nozzles on the auxiliary printhead 304 which are aligned with those obscured nozzles. The controller also adjusts, as appropriate, the timing of the nozzle control data for the nozzles on the auxiliary printhead to compensate with the different horizontal position of the auxiliary printhead 304.

This process is repeated as the nozzle wiping module 112 is moved along the length of the print bar 102 to a second parking zone.

In FIG. 4*a* is illustrated an example when the nozzle wiping module 112 has started to move from the first parking position. In this example, nozzles on the auxiliary printhead 304 are aligned with nozzles on a printhead 104 on the print bar 102 which are obscured by the nozzle wiping module 112.

The printer controller 114 can accurately determine which nozzles are obscured by the nozzle wiping module 112 based, for example, on encoder or position detectors on the nozzle wiping module 112.

A first set 406 of the nozzles 402 on printhead 104*a* are thus rendered inactive by the nozzle redundancy controller 310, whilst the remaining nozzles remain active. Nozzle firing data generated by the nozzle control data generator 116 intended for the first set 406 of inactivated nozzles is diverted to the set 410 of nozzles on the auxiliary printhead 304 that are aligned with the inactivated set 406 of nozzles 402 on the printhead 104*a*.

In one example the set of nozzles rendered inactive by the nozzle redundancy controller 310 covers more nozzles than are actually obscured by the nozzle wiping mechanism 112. This allows for an additional safety margin of a predetermined number of nozzles. In other examples, however, just those nozzles obscured by the nozzle wiping mechanism 112 may be rendered inactive. In FIG. 4*a*, it can be seen that a set 412 of nozzles of auxiliary printhead 304 are not aligned with any printhead nozzles, hence this set of nozzles are also rendered inactive.

Figure 4B:
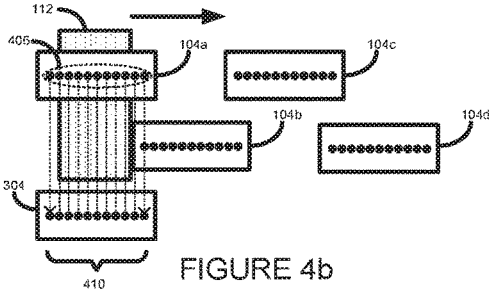
Figure 5:
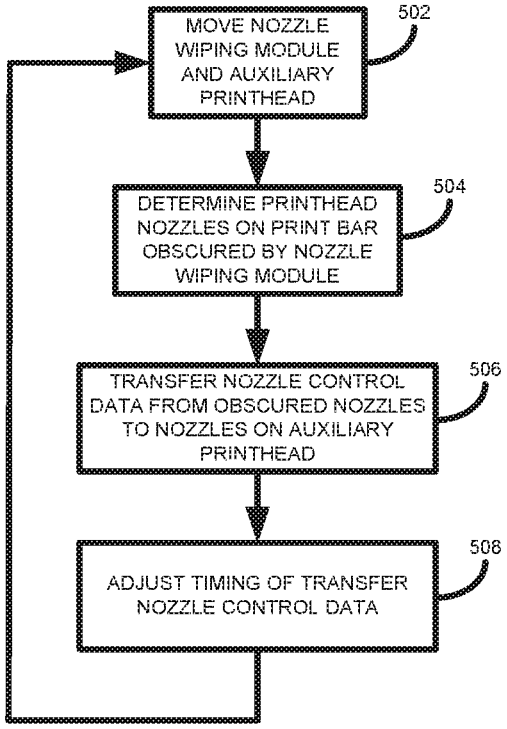
FIG. 5 is a flow diagram outlining an example method according to one example.

In FIG. 4*b*, the nozzle wiping mechanism 112 and auxiliary printhead 304 have advanced along the print bar 102. The majority of the nozzles 402 of printhead 104*a* are obscured by the nozzle wiping mechanism 112, and with the above-mentioned safety margin, a set 406 comprising all of the nozzles of printhead 104*a* are rendered inactive by the nozzle redundancy controller 310, whilst a set 410 comprising all of the nozzles on auxiliary printhead 304 are activated. Nozzle firing data generated by the nozzle control data generator 116 intended for the inactivated nozzles of printhead 104*a* is diverted to the set 410 of active nozzles of the auxiliary printhead 304.

In FIG. 4*c*, the nozzle wiping mechanism 112 and auxiliary printhead 304 have further advanced along the print bar 102, such that a first set 406*a* of nozzles of the printhead 104*a* are inactivated by the nozzle redundancy controller 310 along with a set 406*b* of nozzles of the printhead 104*b*. Nozzle firing data generated by the nozzle control data generator 116 intended for the sets (406*a* and 406*b*) of inactivated nozzles of printhead 104*a* is diverted to the set 410 of active nozzles of the auxiliary printhead 304.

Figure 4D:
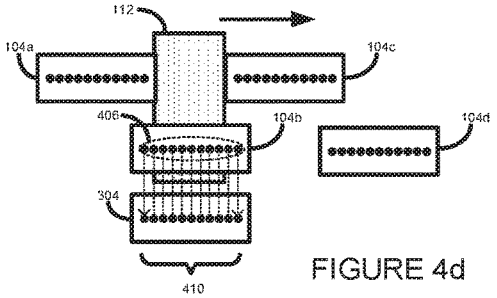

In FIG. 4*d*, the nozzle wiping mechanism 112 and auxiliary printhead 304 have still further advanced along the print bar 102, such that a set 406 of nozzles of the printhead 104*b* are inactivated by the nozzle redundancy controller 310. Nozzle firing data generated by the nozzle control data generator 116 intended for the set 406 of inactivated nozzles of printhead 104*b* is diverted to the set 410 of active nozzles of the auxiliary printhead 304.

In the present example the nozzle wiping mechanism 112 and auxiliary printhead 304 are moved synchronously. In one example, the nozzle wiping mechanism 112 and auxiliary printhead 304 may be mounted on the same movable carriage, such as the auxiliary carriage 302. In another example the nozzle wiping mechanism 112 and auxiliary printhead 304 may be moved substantially synchronously.

It will be appreciated that examples and embodiments of the present invention can be realized in the form of hardware, software or a combination of hardware and software. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples of the present invention. Examples of the present invention may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A printing system comprising:

a print bar;

a plurality of printheads installed on the print bar;

an auxiliary printhead moveable parallel to the print bar, wherein a number of first nozzles of the auxiliary printhead substitute for a number of second nozzles of the printheads during a nozzle servicing operation performed on the second nozzles; and a nozzle redundancy controller to divert nozzle firing data generated by a nozzle control data generator for controlling first nozzle circuitry of the printheads to second nozzle circuitry of the auxiliary printhead in response to a determination that a nozzle servicing module is obscuring the second nozzles of the printheads, wherein the nozzle redundancy controller modifies a timing of the nozzle firing data based on a horizontal distance between the printheads on the print bar and the auxiliary printhead.

2. The printing system of claim 1, further comprising a nozzle servicing module moveable across a length of the print bar to perform the nozzle servicing operation on the second nozzles of the printheads.

3. The priming system of claim 2, wherein the nozzle redundancy controller diverts the nozzle firing data in response to a determination that the nozzle servicing module is obscuring at least one of the second nozzles of at least one of the printheads.

4. The printing system of claim 3, further comprising a printer controller to:

instruct the nozzle servicing module to perform a nozzle servicing operation;

move a printhead carriage coupled to the auxiliary printhead in synchronization with the nozzle servicing module; and instruct the nozzle redundancy controller to divert the nozzle firing data.

5. The printing system of claim 2, wherein the nozzle servicing module further comprises a nozzle wiping element to selectively perform a wiping operation on a number of the second nozzles.

6. The printing system of claim 5, wherein the nozzle wiping element is less than 10 mm in thickness.

7. The printing system of claim 1, wherein the print bar is stationary.

8. The printing system of claim 1, wherein the nozzle servicing operation is performed during a printing operation.

9. The printing system of claim 1, wherein the auxiliary printhead substitutes nozzles for more than one printhead simultaneously.

10. The printing system of claim 1, wherein the auxiliary printhead leads the first nozzles with respect to the second nozzles before the second nozzles are obscured by the nozzle servicing module.

11. A method of performing a service operation on a number of printheads coupled to a print bar comprising:

during a printing operation, moving a nozzle servicing module to perform a servicing operation on a number of first nozzles of at least one printhead coupled to a print bar;

positioning a number of second nozzles of an auxiliary printhead in alignment with a number of the first nozzles obscured by the nozzle servicing module;

transferring, with a nozzle redundancy controller, nozzle firing data intended for nozzle circuitry of the first nozzles that are obscured by the nozzle servicing module to nozzle circuitry of the second nozzles of the auxiliary printhead; and modifying with the nozzle redundancy controller a timing of the nozzle firing data based on a horizontal distance between the printheads on the print bar and the auxiliary printhead.

12. The method of claim 11, further comprising moving a printhead carriage coupled to the auxiliary printhead in synchronization with the nozzle servicing module.

13. The method of claim 11, wherein performing a servicing operation on a number of first nozzles of at least one printhead coupled to a print bar comprises, with a nozzle wiping element, performing a wiping operation on a number of the first nozzles.

14. The method of claim 11, wherein moving the nozzle servicing module to perform a servicing operation and positioning the second nozzles of the auxiliary printhead in alignment with the first nozzles obscured by the nozzle servicing module comprises moving a printhead carriage coupled to the auxiliary printhead in synchronization with the nozzle servicing module.

15. The method of claim 11, wherein positioning the second nozzles of the auxiliary printhead in alignment with the first nozzles obscured by the nozzle servicing module comprises leading the first nozzles with the second nozzles before the first nozzles are obscured by the nozzle servicing module.

16. A computer program product for performing a nozzle servicing, the computer program product comprising:

a computer readable storage medium comprising computer usable program code embodied therewith, the computer usable program code to, when executed by a processor:

perform a printing operation;

during the printing operation, move a nozzle servicing module to perform a servicing operation on a number of first nozzles of at least one printhead coupled to a print bar;

position a number of second nozzles of an auxiliary printhead in alignment with a number of the first nozzles obscured by the nozzle servicing module;

transfer, with a nozzle redundancy controller, nozzle firing data intended for nozzle circuitry of the first nozzles that are obscured by the nozzle servicing module to nozzle circuitry of the second nozzles of the auxiliary printhead; and modify a timing of the nozzle firing data based on a distance between the printheads coupled to the print bar and the auxiliary printhead.

17. The computer program product of claim 16, further comprising computer usable program code to, when executed by the processor, move a printhead carriage coupled to the auxiliary printhead in synchronization with the nozzle servicing module.

18. The computer program product of claim 16, further comprising computer usable program code to, when executed by the processor, perform a wiping operation with a nozzle wiping element on a number of the first nozzles.

19. The computer program product of claim 16, further comprising computer usable program code to, when executed by the processor, substitute, with the auxiliary printhead, nozzles for more than one printhead simultaneously.

20. The computer program product of claim 16, further comprising computer usable program code to, when executed by the processor, lead, with the auxiliary printhead, the second nozzles with respect to the first nozzles before the first nozzles are obscured by the nozzle servicing module.

* * * * *